United States Patent [19]

Nunes, Jr.

[11] 4,299,290

[45] Nov. 10, 1981

[54] GRADING MACHINE AND BLADE MOVING STRUCTURE THEREFOR

[76] Inventor: John F. Nunes, Jr., 2006 Loquot Ave., Patterson, Calif. 95363

[21] Appl. No.: 165,347

[22] Filed: Jul. 2, 1980

Related U.S. Application Data

[63] Continuation of Ser. No. 893,986, Apr. 6, 1978, abandoned.

[51] Int. Cl.[3] ..... E02F 3/76; E02F 3/85

[52] U.S. Cl. ..... 172/4.5; 172/445.1; 172/448; 172/449

[58] Field of Search ..... 172/779, 780, 799, 4.5, 172/413, 417, 448, 451, 484, 449

[56] References Cited

U.S. PATENT DOCUMENTS

| | | | |
|---|---|---|---|
| 2,732,640 | 1/1956 | Kirchner | 172/4.5 |
| 2,787,066 | 4/1957 | Johnson | 172/4.5 |
| 3,032,902 | 5/1962 | Shumaker | 172/4.5 |
| 3,090,141 | 5/1963 | Shumaker | 172/448 X |
| 3,234,669 | 2/1966 | Kachnik et al. | 172/448 X |
| 3,353,288 | 11/1967 | Waterson | 172/4.5 |
| 3,559,746 | 2/1971 | Couser | 172/417 X |
| 3,887,012 | 6/1975 | Scholl et al. | 172/4.5 |

*Primary Examiner*—Richard T. Stouffer

[57] ABSTRACT

A mobile grading machine and method with a scraper structure including a grading blade supported by caster wheels trailing therebehind. A trailing connection is disposed between the scraper structure and the caster wheels in fixed lateral relation relative to the ends of the blade. A fixed towing connection is carried at a leading portion of the scraper adapted to be coupled to a towing assembly of a tractor in a manner so as to support the grading structure for terrain following movement. A laser sensor or receiver is carried by the grading machine for raising and lowering the grading blade as the receiver falls and rises in traveling across a field. The grading blade and receiver are sufficiently closely spaced longitudinally so as to cause the receiver to detect a change in the surface of the terrain substantially coincident with the arrival of the blade at the detected change.

5 Claims, 9 Drawing Figures

78
77
73
79
117
114
113
108
109
111
112
84
87
118
116
38
7
76
91
93
92a
98
97
90
88
92
94
96
89
99
129
128
124
121
126
86
39
47
36
41
131
37
57
51
52
63
55
48
66
54
71
72
56
64
67
61
68
69
62
21

GRADING MACHINE AND BLADE MOVING STRUCTURE THEREFOR

This is a continuation of application Ser. No. 893,986, filed Apr. 6, 1978, now abandoned.

BACKGROUND OF THE INVENTION

This invention pertains to a mobile grading machine and more particularly to one in which separate means can be readily operated either selectively or automatically in order to properly position the grading blade as well as to lift the entire grading assembly from the ground in order to permit relatively simple maneuvering of the grading machine.

Heretofore, land leveling machines and equipment have typically been characterized by an elongate frame structure pivotally mounted to a tongue to be drawn by a tractor or other hauling vehicle. Grading machines of the foregoing type have a number of disadvantages when it is desired to precisely grade a plot of ground. Where the plot of ground is relatively small a significant portion of the plot will be difficult, if not impossible, to reach using a conventional grading machine of the kind described and as referred to in FIG. 2.

Accordingly, the corners of such a plot will typically remain ungraded due to the inability of the apparatus to readily obtain access fully into such corners.

As will be readily evident from the description which follows according to the method of the invention a grading machine 20 as disclosed herein is capable of being backed up very closely to the side of a plot of ground so as to grade substantially all of the ground within the given plot.

Further, as well be disclosed further below the method presented in FIG. 3 further includes the step of lifting the blade clear of the ground by lifting the grading machine entirely off of the ground while backing grading machine 20 into the corner.

Thus, as shown in FIG. 2, as known in the prior art, a tractor 10 or other towing means is coupled to a grading machine 11 by means of a tongue 12. Machine 11 includes an elongate rigid frame 15, a fixed axle 13 at the trailing end thereof which carries a pair of wheels 14 on its ends, and a steering axle 16 which supports the leading end of frame 15 to guide grading machine 11 under control of the direction of tongue 12. Thus axle 16 pivots about an axis normal to the supporting surface thereunder. Frame 15 carries a grading blade 19 substantially midway between the ends thereof.

Typically grading machines of the type shown in FIG. 2 have a substantial length whereby it will be readily evident that the ungraded portion 17 remaining within a corner angle 18 will be substantial.

According to Applicant's invention a mobile grading machine 20 of a type adapted to be drawn by a tractor 21 or other towing means is arranged to carry out the method of grading an angular corner of a plot of ground using the method described below after first grading as much of the corner as can be graded, such as along the path shown by arrow 24. From inspection and from the explanation further below it is readily evident that a smaller corner plot 26 remains to be graded after making the corner turn 24 using Applicant's construction than the corner plot 17 using that of the prior art. However, Applicant is further able to grade substantially all of the corner plot 26 by means of the method of backing the grading machine 20 in the direction of one of the arrowheads 22, 23 so as to back the grading machine into the corner alongside a first side 27, 29 of the corner angle with the grading blade of the grading machine raised to a position clear of the ground. Next the grading blade is lowered followed by moving grading machine 20 forwardly out of the corner in the direction of arrowhead 28, 31 so as to grade a first portion of the corner. The next step is to back the grading machine 20 into the corner alongside a second side 27, 29 of the corner angle with the grading blade raised clear of the ground followed by lowering the blade into grading relation with the ground. Then machine 20 is moved forwardly in the direction of arrowhead 31,28 out of the corner so as to grade a second portion of the corner plot partially overlapping the first portion thereby grading the ground within the corner.

As is known, lasers have been employed heretofore in conjunction with grading machines for controlling the position of the grading blade so as to achieve a predetermined grading angle. Typically, a laser generator serves to rotate and project a laser beam in a manner defining a plane of energy adapted to be received by a sensor carried by the grading machine. In response to determining that the sensor has dropped below the "plane" of energy, means are activated for lifting the blade so as not to remove any more material at that "low" point. Similarly, if the sensor detects that it has moved above the plane of energy, means are activated for moving the blade downwardly in order to remove the "high" surface irregularity which has caused the sensor to be moved above the plane of energy. In using apparatus of the kind shown in FIG. 2, if the laser sensor is mounted immediately above the blade it is readily evident that the blade will be activated prematurely in response to the fact that the wheels carried on axle 16 will move up and down in terrain following movement well before blade 19 is adjacent the low or high surface. This movement of axle 16 clearly causes the sensor to move up and down in terrain following movement prematurely. When the sensor is lifted upwardly in terrain following movement it will cause the blade 19 to move downwardly to remove the raised ground surface detected by the front wheels rather than by means disposed proximate blade 19. Accordingly, a gouge will be cut prematurely in advance of the "high" surface (which earlier caused the sensor to indicate that there was a raised surface beneath blade 19) when there was none.

SUMMARY OF THE INVENTION AND OBJECTS

In general a mobile grading machine of the type adapted to be drawn by a tractor or other towing means has been provided employing a scraper structure characterized by a grading blade. Caster wheels disposed in trailing relation to the scraper structure are supported in relation thereto by a trailing connection formed between the caster wheels and the scraper structure. The trailing connection serves to maintain the swivel axles of the caster wheels in fixed lateral relation relative to the ends of the blade. A fixed towing connection is formed and carried at the leading portion of the scraper structure so as to be adapted to be coupled to the towing assembly of a tractor. The towing connection serves to support the grading structure in terrain following movement. As thus arranged the grading machine is substantially frameless whereby the angle of the grading blade can be adjusted by adjusting a hydraulic ram interposed between the back panel of the grading structure and the trailing connection.

In general an improved method of grading a field is also employed herein as described earlier above.

It is a general object of the present invention to provide an improved grading machine.

It is another object of the invention to provide a grading machine of a type adapted to be towed in which the grading machine and towing vehicle together provide a significantly reduced turning radius for grading substantially more of each corner of a plot being graded.

It is yet another object of the invention to provide a substantially frameless grading machine so that the leading end of the grading machine can traverse a field in terrain following movement and the angle of the grading blade can be adjusted by moving the scraper structure upwardly or downwardly relative to the surface of the earth, both such movements being independent of the other.

A further object of the present invention is to provide a grading machine carrying a sensor device for detecting a plane of energy for controlling the positioning of the blade in response to detecting the vertical position of the sensor relative to the plane of energy.

The foregoing and other objects of the invention will become more readily evident from the following detailed description of a preferred embodiment when considered in conjunction with the drawings.

BRIEF DESCRIPTION OF THE DRAWINGS

FIGS. 5 and 6 respectively show plan and rear elevation views of a caster wheel mounting assembly according to the invention;

DETAILED DESCRIPTION OF A PREFERRED EMBODIMENT

Figure 1:
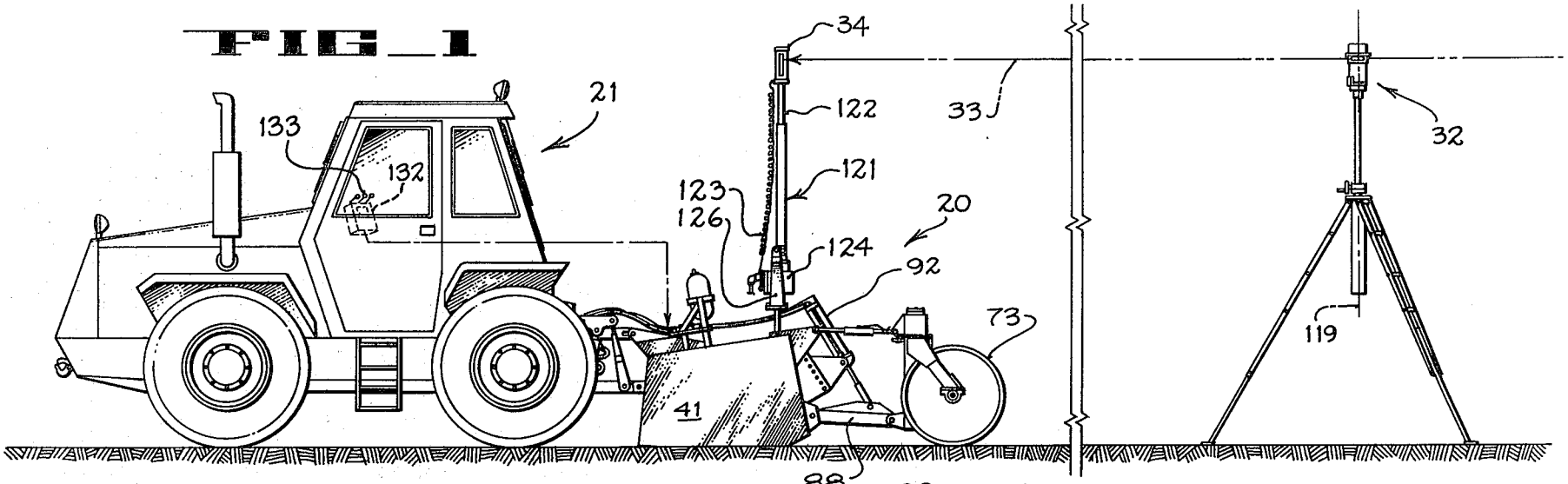
FIG. 1 shows a diagrammatic side elevation view of a grading machine towed by a tractor and operated in response to a laser beam.
Figure 3:
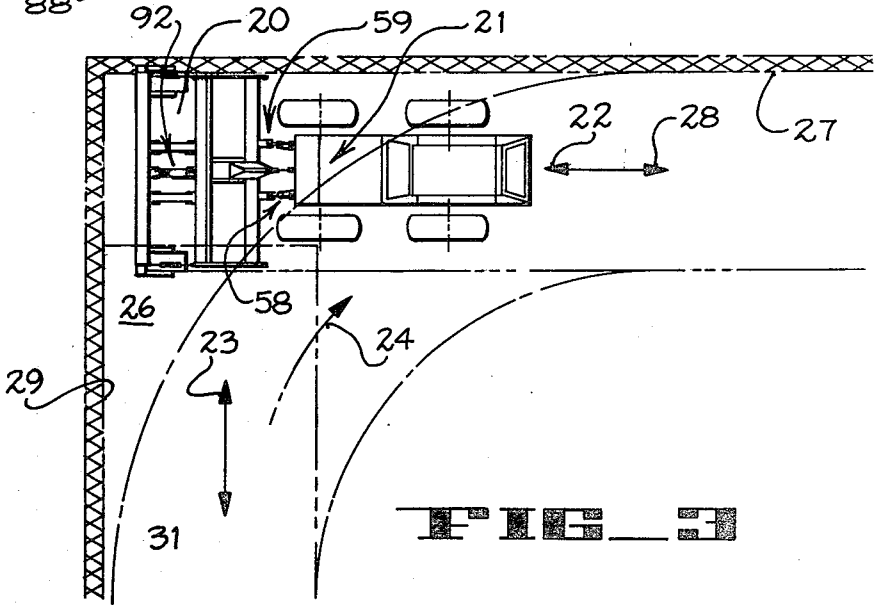
FIG. 3 shows a diagram in plan view of a grading machine carrying out the method according to the invention.
Figure 2:
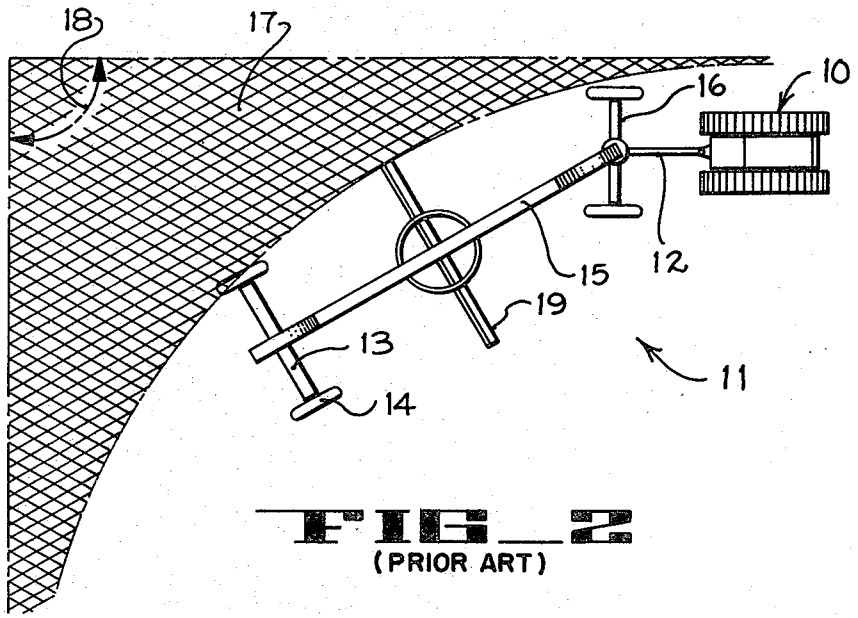
FIG. 2 (PRIOR ART)
FIG. 2 shows a diagram in plan view of a grading machine according to the prior art.

As shown in FIG. 1 a grading machine 20 is shown coupled to a tractor 21 for use in conjunction with a laser generator 32 for transmitting a plane of energy 33 to be detected by a sensor 34 or receiver as described further below.

A scraper structure 36 adapted to be supported between a towing connection 37 and a trailing connection 38 comprises a transversely extending back panel 39, a pair of side panels 41, 42 and a transversely extending box shaped beam 43 extending between the leading upper corners of panels 41, 42. The upper inner edge of panels 41, 42 and back panel 39 include triangularly shaped reinforcing strips 44, 46 to impart rigidity to the upper edge of the bin-like structure 36. A grading or scraping blade 47 extends slightly downwardly below the bottom of structure 36 and curves upwardly and rearwardly within the bin-like structure for collecting limited amounts of scrapings.

Towing connection 37 comprises a pair of laterally spaced bifurcated towing brackets 48 extending forwardly of bin structure 36. Each bracket 48 includes a transversely extending opening adapted to receive a clevis pin 49 therein for connection to a tractor 21. A third connecting bracket 51, formed with a transversely extending opening therein is adapted to receive a connecting pin 52 for coupling structure 36 to be drawn by the tractor. Bracket 51 is displaced from a horizontal plane including bracket 48 and lies in a plane disposed transversely of the horizontal plane and intermediate the brackets 48. Further, connecting pin 52 rides in a slot 53 formed in an end of the upper one of two parallel links 54, 56 protruding rearwardly from tractor 21 in parallel relation.

Tractor 21 carries a so-called "three point hook-up" or coupling assembly 57 adapted to be attached in towing relation to the towing connection defined by brackets 48, 51 and their associated clevis pins.

Coupling assembly 57, carried at the rear of tractor 21 comprises a pair of hydraulically actuated parallelogram linkages 58, 59 which include the pair of parallel links 54, 56. Link 54 is pivoted at its tractor end in a clevis 61 while link 56 is pivotally connected to tractor 21 at a towing pad 62. An elongate quick coupler arm 63 is pivotally coupled at its lower end by pin 64 to link 56 while its upper end is pivotally coupled by pin 66 to a power link 67 pivotally coupled by pin 68 to a clevis 69 carried behind tractor 21. At a third point of power link 67 pin 71 serves to interconnect the upper end of the hydraulic ram 72 to power link 67 while the lower end of ram 72 is pivotally supported upon towing pad 62.

Figures 8, 9:
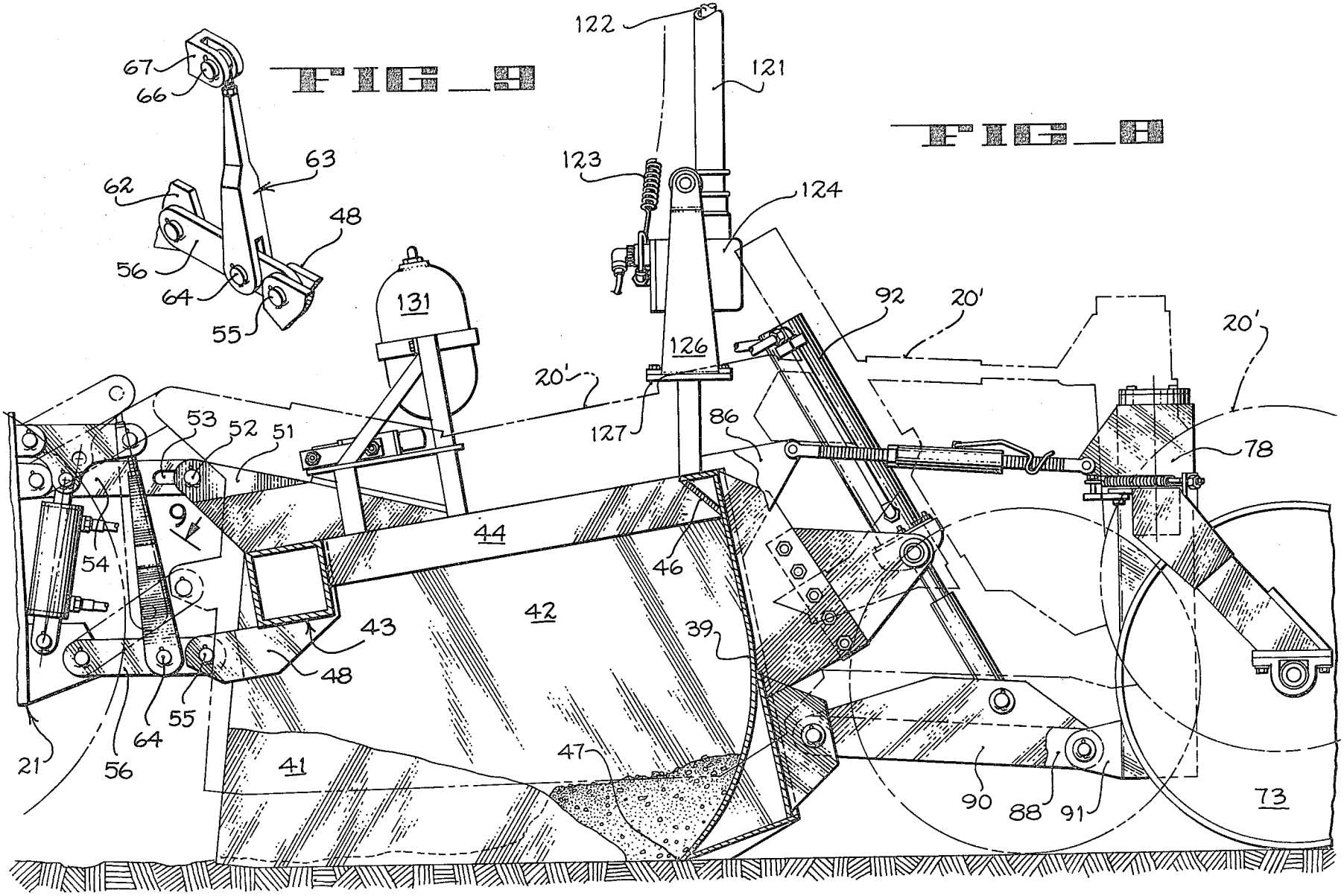
FIG. 8 shows a side elevation view partially broken away for clarity of a grading machine according to the invention demonstrating upward movement of the entire machine as well as the position of the caster wheels during reverse movement of the grading machine.
FIG. 9 shows an enlarged detail perspective view of a portion of the coupling assembly disposed between the grading machine and the tractor as viewed in FIG. 8 at line 9.

By so connecting the coupling assembly of the tractor and the towing connection of the grading machine, it is possible to activate each of rams 72 to pivot power links 67 upwardly thereby drawing links 56 and towing brackets 48 upwardly. During this upward movement connecting pin 52 moves to the rear of slot 53 as shown in FIG. 8 whereby further extension of the piston rod of ram 72 serves to lift the entire grading machine 20 clear of the ground as shown in the phantom line position represented by the reference numeral 20'.

A rigid framework 76 extending transversely across the path of movement of blade 47 carries caster wheels 73, 74 to depend at each end therefrom. Each caster wheel includes an upwardly extending swivel axis 77 (FIG. 7) journaled in an end portion 78 of framework 76. Each wheel 73, 74 is mounted for rotation within an angularly disposed yoke 79 connected to swivel axis 77 so as to cause wheels 73, 74 to take a trailing position in response to movement of machine 20 in any given direction.

Means forming trailing connection 38 (FIG. 4) includes a parallelogram linkage 82, 83 disposed on each side of the longitudinal axis 81 of grading machine 20. Each linkage 82, 83 extends between back panel 39 and framework 76. For example parallelogram 82 comprises an elongate adjustable spacer rod 84, the left end of which is pivotally connected to a mounting pad 86 and the right hand end of which is pivotally connected to an end plate 87 carried by framework 76.

The other half of parallelogram linkage 82 comprises the connecting arm 88 pivotally supported at its left end between the sides of a clevis pad 89 and on its right hand end between the sides of a clevis pad 91. A third connecting arm 90 lies between arms 88 and functions in the same manner except that arm 90 includes a spaced apart upper flange portion 90*a* between the sides of which the lower end 92*a* of a hydraulic ram 92 can be coupled by means of a pin 93.

In addition to the above, ram 92 is further supported by means of the rearwardly extending clamp structure 94 whereby a pin 96 pivotally couples the bottom end of ram 92 therebetween. As thus arranged as piston rod 97 is extended downwardly in the direction of arrowhead 98 scraper structure 36 will be raised as shown by arrow 99 to pivot about connecting pin 55 (FIG. 4).

As inferred above, framework 76 carries caster wheels 73, 74 in a manner to accommodate swivel movement through 360°. Thus, framework 76 comprises an elongate rigid transverse span 101 formed to include a downwardly depending U-shaped frame portion 102. Portion 102 includes downwardly depending rigid arms 103, 104 for carrying the clevis pads 91 while the cross-piece 106 carries a clevis pad 105 for mounting an end of arm 90.

Accordingly, means are provided for lifting and lowering bin structure 36 so as to select the degree to which blade 47 will remove soil while grading.

Figures 4, 7:
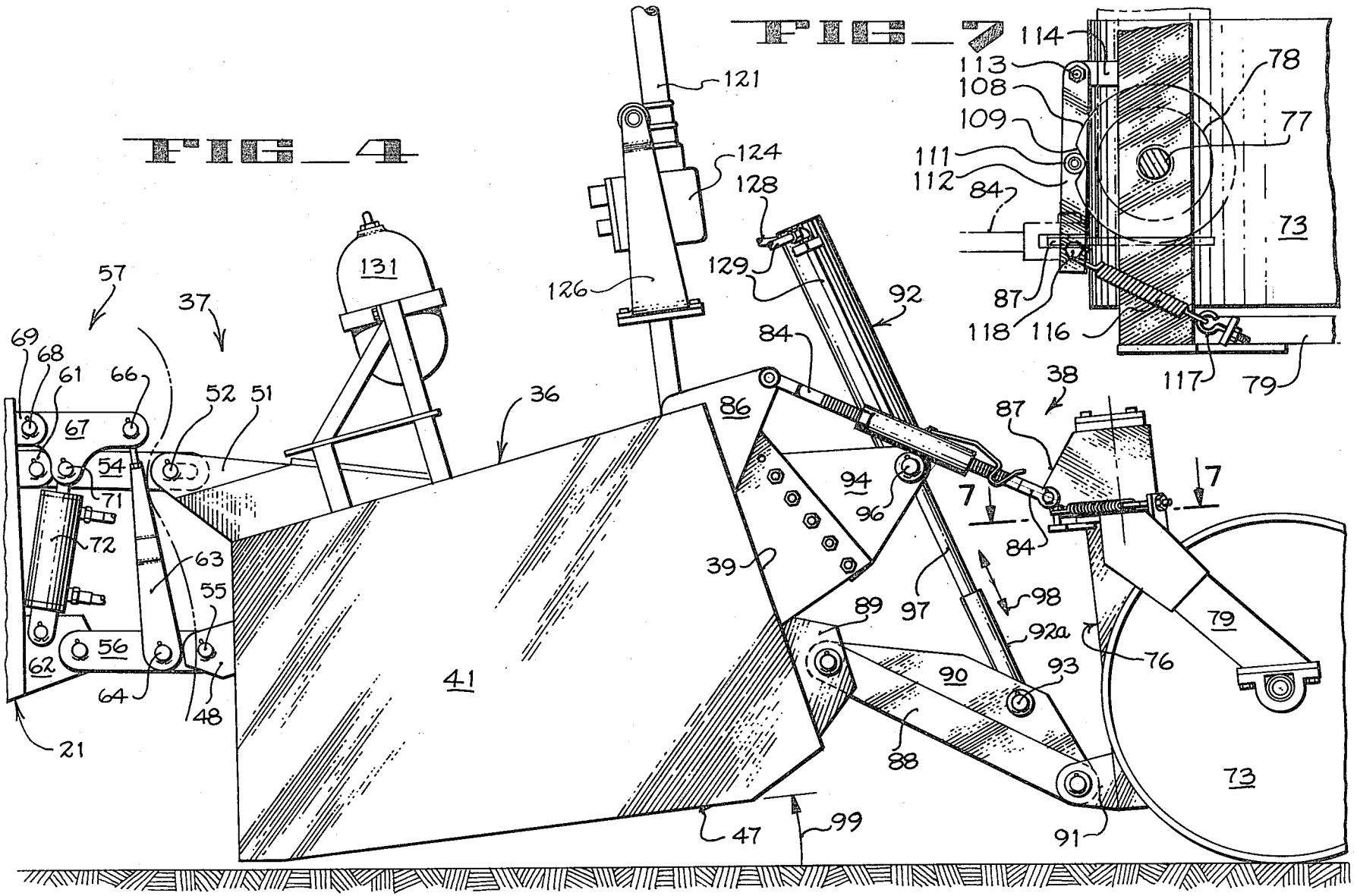
FIG. 4 shows a side elevation view of a grading machine according to the invention with the trailing portion of the scraper structure in a raised position relative to the rear wheels.
FIG. 7 shows an enlarged diagrammatic plan view of a detent mechanism for disposing the caster wheels to trail directly behind the grading machine.
Figure 5:
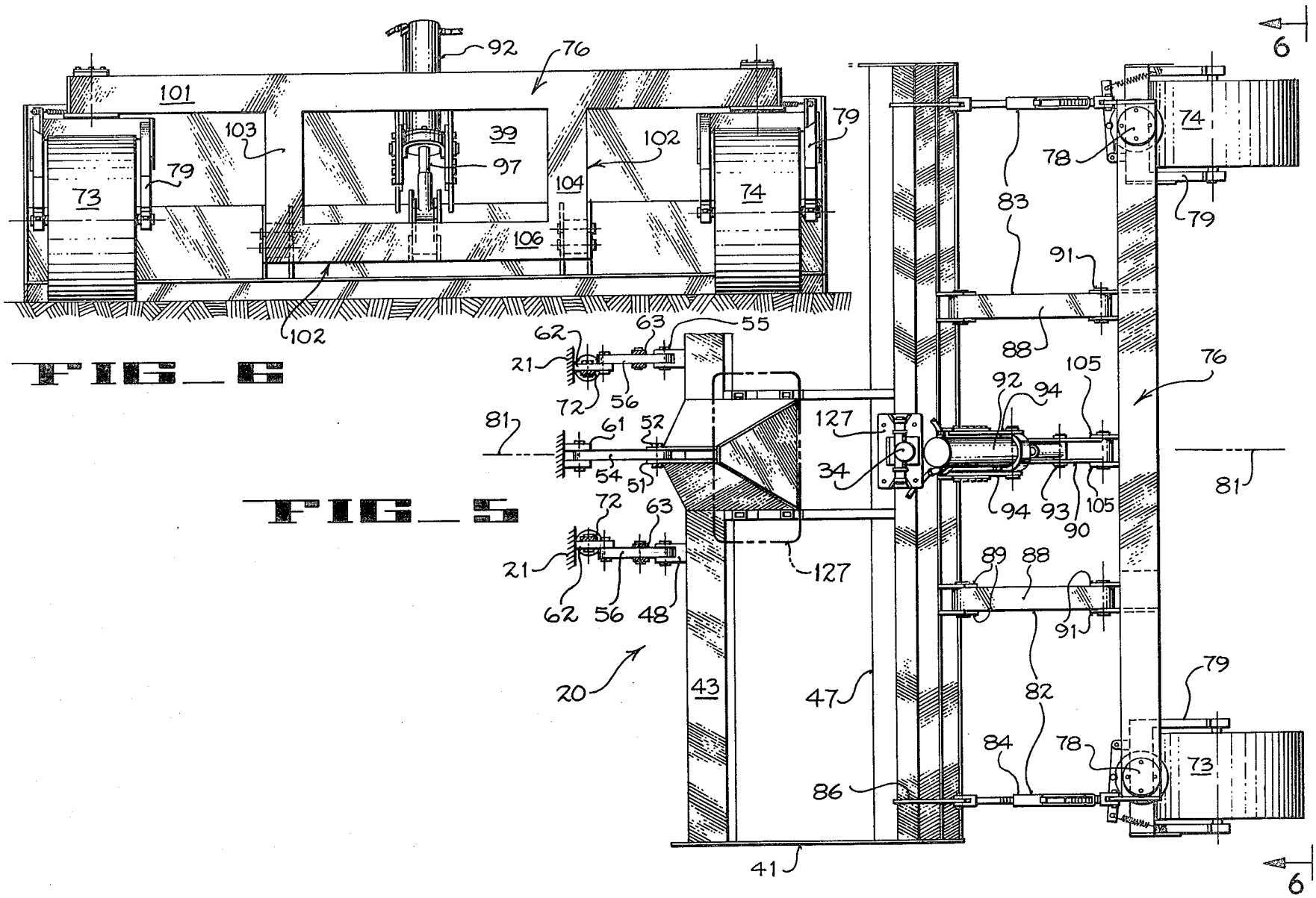

Means serving to apply a limited restraint to the swivel movement of each of the wheels 73, 74 comprises a detent assembly 107 as shown in FIG. 7. Thus, a circular disc 108 formed with a notch 109 is coupled to rotate with swivel axis 77. A detent or dog 111 carried on a pivot arm 112 rides into and out of notch 109 depending upon the directional orientation of the underlying caster wheel associated with swivel axis 77. Pivot arm 112 is arranged to be pivoted about a fixed axis 113 supported by the bracket 114 carried by framework 76.

A spring 116 anchored to the framework by a hook 117 at one end and to the shank of a bolt 118 on pivot arm 112 at the other end serves to apply a spring force to pivot arm 112 tending to urge detent 111 into notch 109.

As noted at the outset above, in the grading of a field to a predetermined slope a laser generator 32 serves to project a beam of energy as the beam is rotated through 360° about the axis 119. In this way a plane 33 of energy is defined to be transmitted to receiver or sensor 34. A hydraulically operated extensible mast assembly 121 includes an inner support post 122 and electric connections represented by the coil 123 extending between sensor 34 and control box 124.

A trunnion 126 mounted upon a support platform 127 carries mast assembly 121 between its upper ends so as to permit the last to be pivotally moved to a precise vertical orientation.

Means responsive to receiver 34 for raising and lowering the grading blade 47 as receiver 34 falls and rises in traveling across a field to be graded comprises known means responsive to the electronic signals from the receiver 34. These signals serve to activate valving in control box 124 so as to cause piston rod 97 of ram 92 to be extended or retracted via the double acting hydraulic lines 128, 129.

As noted above the leading end of machine 20 is supported in terrain following movement by pivot pin 55. Thus as the rear wheels of tractor 21 rise up to pass over a high spot in the field, sensor 34 will also rise up at substantially the same time. However, blade 47 is disposed at substantially the same displacement behind the rear wheels of tractor 21 or more importantly behind the pivot axis defined by pin 55 for the bin-like structure 36. However, both the grading blade 47 and sensor 34 are disposed sufficiently immediately behind the means for supporting the end of the machine so that the receiver serves to detect a change in the surface of the terrain substantially coincident with the arrival of blade 47 at the detected change in terrain.

Finally, a surge tank 131 is shown which serves to accommodate surges in the hydraulic system as is known in the art.

As shown in FIG. 1 an electronic control unit 132 provides a continuous display in response to the positioning of sensor 34 above, below, or in the plane of plane 33 as is known. In automatic operation, of known type, controller 132 serves to automatically operate the hydraulic means as noted above for properly positioning grading blade 47.

In addition, manual overriding controls 133 can be employed to manually activate the hydraulic system by overriding the controls provided by sensor 34, all as is known.

From the foregoing it will be readily evident that there has been provided an improved grading machine which can be readily attached to the back of a tractor and drawn across a field to provide precise and accurate leveling of an entire field including full penetration into the corners thereof.

I claim:

1. In a mobile grading machine of a type adapted to be drawn by a tractor or other towing means comprising a scraper structure including a grading blade, a four sided rigid structure including side and back panels and rigid means extending transversely between said side panels for spacing same, said blade being disposed to extend between said side panels adjacent said back panel, caster wheels carried by said back panel in adjacent trailing relation to said back panel, means forming a trailing parallelogram connection extending between said back panel and said caster wheels, said trailing connection serving to maintain the swivel axles of said caster wheels in fixed lateral relation relative to the ends of said blade, means forming a fixed towing connection carried at a leading portion of said rigid structure adapted to be coupled to a towing assembly of a tractor or other pulling means and supporting said rigid structure in terrain following movement, extensible means coupled between said back panel and said trailing connection for lifting and lowering the rear of said rigid structure to tip same about a transverse axis through the first named towing connection to cause said extensible means to control the angle of said blade with respect to the ground beneath.

2. A mobile grading machine according to claim 1 further comprising a laser receiver carried by said rigid structure, means responsive to said receiver for tipping the grading blade between advanced and retracted positions as said receiver falls and rises in traveling across a field to be graded, means for supporting the leading end of said rigid structure in terrain following movement, means disposing said grading blade and receiver sufficiently immediately behind the last named means in a manner to cause said receiver to detect a change in the surface of the terrain substantially coincident with the arrival of said blade at said detected change in terrain.

3. In a mobile grading machine of a type adapted to be drawn by a tractor or other towing means comprising a bin-like scraper structure partially open at the bottom and having a back panel thereacross, a scraper blade disposed to extend across the bottom, caster wheels disposed in adjacent trailing relation to said back panel, a parallelogram connection between said back panel and said caster wheels, extensible hydraulic means interposed between said caster wheels and said panel serving to selectively tip said blade relative to the ground, a towing connection protruding forwardly of said bin-like structure adapted to engage a towing connection of a tractor or other towing means and forming a pivot point about which said scraper structure can move as said blade is tipped.

4. In a mobile grading machine according to claim 1 in which the towing assembly comprises a parallelogram linkage protruding forwardly from said rigid structure adapted to be coupled to a tractor, and extensible hydraulic means to be coupled at one end to the tractor and at an opposite end to said linkage for moving said parallelogram linkage upwardly to lift said rigid structure and said caster wheels clear of the ground for maneuvering the tractor in a manner uninhibited by said caster wheels.

5. In a mobile grading machine of a type adapted to be drawn by a tractor or other towing means, a scraper structure including a grading blade, cyclic support means disposed to travel behind and substantially adjacent said scraper structure, first coupling means supporting said scraper structure from said cyclic support means, second coupling means disposed in advance of said blade for supporting said scraper structure from the towing means, first extensible means interposed between said second coupling means and said towing means for lifting and lowering the leading edge of said scraper structure, second extensible means interposed between said first coupling means and said scraper structure for lifting and lowering the trailing edge of said scraper structure, a laser receiver carried by said scraper structure for detecting changes in the terrain with respect to a predetermined plane, means responsive to said receiver for operating said first and second extensible means for raising and lowering the grading blade as the scraper structure and receiver rise and fall with respect to said predetermined plane in traveling across a field to be graded, said first and second coupling means serving to permit said scraper structure and said receiver to rise and fall in terrain following movement substantially independently of terrain following movements of the towing means so as to detect changes in the surface of the terrain substantially coincident with the arrival of said blade at the detected change in terrain.

* * * * *